United States Patent [19]

Evans et al.

[11] Patent Number: 4,588,553

[45] Date of Patent: May 13, 1986

[54] ALUMINIUM ALLOYS

[75] Inventors: Brian Evans, Aldershot; Christopher J. Peel, Fleet, both of England

[73] Assignee: The Secretary of State for Defence in Her Brittanic Majesty's Government of the United Kingdom of Great Britain and Northern Ireland, London, England

[21] Appl. No.: 468,592

[22] Filed: Feb. 22, 1983

[30] Foreign Application Priority Data

Feb. 26, 1982 [GB] United Kingdom ..... 8205746
Mar. 26, 1982 [GB] United Kingdom ..... 8209010

[51] Int. Cl.[4] ..... C22C 21/16

[52] U.S. Cl. ..... 420/533; 148/417; 148/439

[58] Field of Search ..... 420/529, 533; 148/417, 148/439

[56] References Cited

U.S. PATENT DOCUMENTS 2,381,219 8/1945 Le Baron ..... 420/529
2,915,390 12/1959 Criner ..... 420/532
2,915,391 12/1959 Criner ..... 148/439

FOREIGN PATENT DOCUMENTS 1927500 2/1971 Fed. Rep. of Germany .
2127909 12/1972 Fed. Rep. of Germany .
518023 11/1921 France .
1148719 12/1957 France .
1161306 10/1958 France .
2190930 2/1974 France .
216204 11/1941 Switzerland .
1172736 12/1969 United Kingdom .
1572587 7/1980 United Kingdom .

OTHER PUBLICATIONS

"Aluminium und Aluminiumlegierungen", by Dr. D. Altenpohl, p. 705, 1965.
"Improved Aluminum Alloys for Airframe Applications", by M. W. Hyatt et al., Mar. 1977, pp. 56–59, Metal Progress.
Proceedings "First International Aluminum-Lithium Conference", 19–21 May 1980, Pub. Metallurgical Society of AIME.
American Metal Market/Metal Working News of 29 Dec. 1980.
Lockheed Report No. LMSC-D766966 (Sept. 1980) p. 10.

*Primary Examiner*—R. Dean
*Attorney, Agent, or Firm*—Cushman, Darby & Cushman

[57] ABSTRACT

Aluminium alloys having compositions within the ranges (in wt %) 2 to 2.8 lithium—0.4 to 1 magnesium—1 to 1.5 copper—0 to 0.2 zirconium—0 to 0.5 manganese—0 to 0.5 nickel—0 to 0.5 chromium—balance aluminium. The alloys are precipitation hardenable and exhibit a range of properties, according to heat treatment, which make them suitable for engineering applications where light weight and high strength are required.

10 Claims, No Drawings

ALUMINIUM ALLOYS

This invention relates to aluminium alloys containing lithium, in particular to those alloys suitable for aerospace applications.

It is known that the addition of lithium to aluminium alloys reduces their density and increases their elastic moduli producing significant improvements in specific stiffnesses. Furthermore the rapid increase in solid solubility of lithium in aluminium over the temperature range 0° to 500° C. results in an alloy system which is amenable to precipitation hardening to achieve strength levels comparable with some of the existing commercially produced aluminium alloys.

Up to the present time the demonstrable advantages of lithium containing alloys have been offset by difficulties inherent in the actual alloy compositions hitherto developed and the conventional methods used to produce those compositions. Only two lithium containing alloys have achieved significant usage in the aerospace field. These are an American alloy, X2020 having a composition Al—4.5Cu—1.1Li—0.5Mn—0.2Cd (all figures relating to composition now and hereinafter are in wt%) and a Russian alloy, 01420, described in U.K. Pat. No. 1,172,736 by Fridlyander et al and containing Al—4 to 7 Mg—1.5 to 2.6 Li—0.2 to 1.0 Mn—0.05 to 0.3 Zr (either or both of Mn and Zr being present.

The reduction in density associated with the 1.1% lithium addition to X2020 was 3% and although the alloy developed very high strengths it also possessed very low levels of fracture toughness making its efficient use at high stresses inadvisable. Further ductility relates problems were also discovered during forming operations.

The Russian alloy 01420 possesses specific moduli better than those of conventional alloys but its specific strength levels are only comparable with the commonly used 2000 series aluminum alloys so that weight savings can only be achieved in stiffness critical applications.

Both of the above alloys were developed during the 1950's and '60's a more recent alloy published in the technical press has the composition Al—2Mg—1.5Cu—3Li—0.18Zr. Whilst this alloy possesses high strength and stiffness the fracture toughness is still too low for many aerospace applications. In attempts to overcome problems associated with high solute contents such as, for example, cracking of the ingot during casting or subsequent rolling, many workers in the field have turned their attention to powder metallurgy techniques. These techniques whilst solving some of the problems of a casting route have themselves many inherent disadvantages and thus the problems of one technique have been exchanged for the problems of another. Problems of a powder route include those of removal of residual porosity, contamination of powder particles by oxides and practical limitations on size of material which can be produced.

It has now been found that relatively much lower additions of the alloying elements magnesium and copper may be made and by optimising the production process parameters and subsequent heat treatments alloys possessing adequate properties including a much higher fracture toughness may be produced.

In the present alloys, the alloy composition has been developed to produce an optimum balance between reduced density, increased stiffness and adequate strength, ductility and fracture toughness to maximise the possible weight savings that accrue from both the reduced density and the increased stiffness.

According to the present invention, therefore, an aluminium based alloy has a composition within the following ranges, the ranges being in weight percent:

| | |
|---|---|
| Lithium | 2.0 to 2.8 |
| Magnesium | 0.4 to 1.0 |
| Copper | 1.0 to 1.5 |
| Zirconium | 0 to 0.2 |
| Manganese | 0 to 0.5 |
| Nickel | 0 to 0.5 |
| Chromium | 0 to 0.5 |
| Aluminium | Balance |

Optional additions of one or more of the elements zirconium, manganese, chromium and nickel may be made to control other metallurgical parameters such as grain size and grain growth on recrystallisation.

A preferred range for a zirconium addition would be 0.1 to 0.15 weight percent.

A major advantage of the more dilute lithium containing alloys is that production and processing are greatly facilitated. Alloys according to the present invention may be produced by conventional casting techniques such as, for example, direct chill semi-continuous casting. The casting problems associated with known alloys have led many workers to use production techniques based on powder metallurgy routes.

Owing to their lower solute contents the present alloys are more easily homogenised and subsequently worked than previous alloys having relatively high solute contents.

Because of their advantageous mechanical and physical properties including low density and excellent corrosion resistance, the latter property also being partly attributable to the lower solute content, the alloys are particularly suitable for aerospace airframe applications. The density of an alloy having the composition Al—2.44Li—0.56Mg—1.18Cu—0.13Zr is 2.54 g/ml this compares favourably with the density of 2014 alloy, the example, which is 2.8 g/ml. This is a density reduction of over 9% on a conventional alloy having comparable properties. It will be appreciated that alloys of the present invention also enjoy an additional advantage by virtue of their lower solute content in that they have less of the heavier elements which increase density.

In sheet applications a preferred magnesium content is approximately 0.7%. It has been found that the magnesium level is critical in terms of the precipitating phases and subsequent strength levels.

Examples of alloys according to the present invention will now be given together with properties and corresponding heat treatment data.

EXAMPLE No. 1

Composition Al—2.32Li—0.5Mg—1.22Cu—0.12Zr

The alloy ingot was homogenised, hot-worked to 3 mm thickness and cold rolled to 1.6 mm with inter stage annealing.

The alloy sheet was then solution treated, cold water quenched and stretched 3%.

Table 1 below gives average test results for the various ageing times at 170° C.

TABLE 1

| Example No | Ageing time (hrs) | 0.2% Proof Stress MPa | Tensile Strength MPa | Elong % | Elastic Modulus E.GPa | Fracture Toughness Kc, MPa√m |
|---|---|---|---|---|---|---|
| 1 | 1½ | 326 | 414 | 6.5 | 76.7 | 87.9 |
| 1 | 5 | 381 | 450 | 4.5 | 80.0 | 68.3 |
| 1 | 8 | 389 | 458 | 4.5 | 79.5 | 79.7 |
| 1 | 24 | 426 | 489 | 3.5 | 80.2 | 64.8 |
| 1 | 64 | 455 | 503 | 6.0 | 83.0 | 46.5 |

EXAMPLE No. 2

Composition Al—2.44Li—0.56Mg—1.18Cu—0.13Zr

Alloy processing details as for Example No. 1. Test results are given below in Table 2.

TABLE 2

| Example No | Ageing time (hrs) | 0.2% Proof Stress MPa | Tensile Strength MPa | Elong % | Elastic Modulus E.GPa | Fracture Toughness Kc, MPa√m |
|---|---|---|---|---|---|---|
| 2 | 1½ | 313 | 389 | 7.2 | 78.8 | 79.2 |
| 2 | 8 | 391 | 464 | 6.2 | 78.0 | — |

EXAMPLE No. 3

Composition Al—2.56Li—0.73Mg—1.17Cu—0.08Zr

Alloy processing details as for Example No. 1 except that the stretching was 2%. Test results are given below in Table 3.

TABLE 3

| Example No | Ageing (time) (hrs) | 0.2% Proof Stress MPa | Tensile Strength MPa | Elong % | Elastic Modulus E.GPa |
|---|---|---|---|---|---|
| 3 | 8 | 409 | 489 | 6.6 | 79.8 |
| 3 | 24 | 416 | 477 | 5.5 | — |
| 3 | 40 | 457 | 518 | 5.5 | — |

EXAMPLE No. 4

Composition Al—2.21Li—0.67Mg—1.12Cu—0.10Zr

Alloy processing details as for Example No 3. Test results are given below in Table 4.

TABLE 4

| Example No | Ageing time (hrs) | 0.2% Proof Stress MPa | Tensile Strength MPa | Elong % | Elastic Modulus E.GPa | Fracture Toughness Kc, MPa m |
|---|---|---|---|---|---|---|
| 4 | 8 | 378 | 447 | 6.5 | 78.7 | 71.3 |
| 4 | 24 | 399 | 468 | 6.0 | 78.0 | 62.9 |

EXAMPLE No. 5

Composition Al—2.37Li—0.48Mg—1.18Cu—0.11Zr

The alloy of this example was tested in the form of 11 mm thick plate.

Average figures are given of longitudinal and transverse test pieces in Table 5 below.

The alloy has not been cross-rolled.

TABLE 5

| Example No | Ageing time (hrs) | 0.2% Proof Stress MPa | Tensile Strength MPa | Elong % | Elastic Modulus E.GPa |
|---|---|---|---|---|---|
| 5 | 8 | 340 | 431 | 7.8 | 82.9 |
| 5 | 16 | 389 | 458 | 7.1 | 82.4 |

TABLE 5-continued

| Example No | Ageing time (hrs) | 0.2% Proof Stress MPa | Tensile Strength MPa | Elong % | Elastic Modulus E.GPa |
|---|---|---|---|---|---|
| 5 | 24 | 399 | 469 | 7.0 | 82.0 |
| 5 | 48 | 422 | 490 | 6.9 | 80.6 |
| 5 | 72 | 432 | 497 | 6.5 | 81.6 |

EXAMPLE No. 6

Composition

Al—2.48Li—0.54Mg—1.09Cu—0.31Ni—0.12Zr

The alloy of this example was tested in the form of 25 mm hot-rolled plate solution treated at 530° C., water quenched and stretched 2%. Test results are given below in Table 6.

TABLE 6

| Example No | Ageing Temp (°C.) | Ageing Time (hrs) | 0.2% Proof Stress MPa | Tensile Strength MPa | Elong % |
|---|---|---|---|---|---|
| 6 | 170 | 16 | 324 | 405 | 6.5 |
| 6 | " | 48 | 389 | 444 | 4.8 |
| 6 | " | 72 | 393 | 462 | 4.8 |
| 6 | 190 | 16 | 358 | 433 | 7.1 |
| 6 | " | 48 | 433 | 482 | 5.5 |

Although all of the material for the examples given above was produced by conventional water cooled chill casting processes the alloy system is however amenable to processing by powder metallurgy techniques. It is considered, however, that a major advantage of the alloys of the present invention lies in the ability to cast large ingots. From such ingots it is possible to supply the aerospace industry with sizes of sheet and plate comparable with those already produced in conventional aluminium alloy.

The examples given above have been limited to material produced in sheet and plate form. However, alloys of the present invention are also suitable for the production of material in the form of extrusions, forgings and castings.

Alloys of the present invention are not limited to aerospace applications. They may be used wherever light weight is necessary such as, for example, in some applications in land and sea vehicles.

We claim:

1. An aluminium based alloy consisting essentially of in weight percent;

| | |
|---|---|
| Lithium | 2.0 to 2.8 |
| Magnesium | 0.4 to 1.0 |
| Copper | 1.0 to 1.5 |
| Zirconium | 0 to 0.2 |
| Manganese | 0 to 0.5 |
| Nickel | 0 to 0.5 |
| Chromium | 0 to 0.5 |
| Aluminium | Balance (except for incidental impurities). |

2. An aluminium alloy according to claim 1, said alloy being produced by an ingot metallurgy route.

3. An aluminium alloy according to claim 1, said alloy having a magnesium content in the range 0.7 to 1.0 weight percent.

4. An aluminium alloy consisting essentially of in weight percent

| | |
|---|---|
| Lithium | 2.32 |
| Magnesium | 0.5 |
| Copper | 1.22 |
| Zirconium | 0.12 |
| Aluminium balance (except for incidental impurities). | |

5. An aluminium alloy consisting essentially of in weight percent;

| | |
|---|---|
| Lithium | 2.44 |
| Magnesium | 0.56 |
| Copper | 1.18 |
| Zirconium | 0.13 |
| Aluminium balance (except for incidental impurities). | |

6. An aluminium alloy consisting essentially of in weight percent;

| | |
|---|---|
| Lithium | 2.56 |
| Magnesium | 0.73 |
| Copper | 1.17 |
| Zirconium | 0.08 |
| Aluminium balance (except for incidental impurities) | |

7. An aluminium alloy consisting essentially of in weight percent;

| | |
|---|---|
| Lithium | 2.21 |
| Magnesium | 0.67 |
| Copper | 1.12 |
| Zirconium | 0.10 |
| Aluminium balance (except for incidental impurities) | |

8. An aluminium alloy consisting essentially of in weight percent;

| | |
|---|---|
| Lithium | 2.37 |
| Magnesium | 0.48 |
| Copper | 1.18 |
| Zirconium | 0.11 |
| Aluminium balance (except for incidental impurities) | |

9. An aluminium alloy consisting essentially of in weight percent;

| | |
|---|---|
| Lithium | 2.48 |
| Magnesium | 0.54 |
| Copper | 1.09 |
| Zirconium | 0.12 |
| Nickel | 0.31 |
| Aluminium balance (except for incidental impurities) | |

10. An aerospace airframe structure produced from an aluminium alloy according to claim 1.

* * * * *

UNITED STATES PATENT AND TRADEMARK OFFICE

CERTIFICATE OF CORRECTION

PATENT NO. : 4,588,553

DATED : May 13, 1986

INVENTOR(S) : Brian EVANS; Christopher J. PEEL

It is certified that error appears in the above-identified patent and that said Letters Patent is hereby corrected as shown below:

1. An aluminium based alloy consisting essentially of the following in weight per cent[;]:

| | |
|---|---|
| Lithium | 2.0 to 2.8 |
| Magnesium | 0.4 to 1.0 |
| Copper | 1.0 to 1.5 |
| and at least one element selected from the group consisting of: | |
| Zirconium | 0 to 0.2 |
| Manganese | 0 to 0.5 |
| Nickel | 0 to 0.5 |
| Chromium | 0 to 0.5 in the amount stated, and |
| Aluminium | [B]balance,[(]except for incidental impurities[)]. |

Signed and Sealed this

Thirtieth Day of December, 1986

*Attest:*

DONALD J. QUIGG

*Attesting Officer*

*Commissioner of Patents and Trademarks*